US005547609A

United States Patent [19]

Fujii et al.

[11] Patent Number: 5,547,609

[45] Date of Patent: Aug. 20, 1996

[54] ELECTROCONDUCTIVE RESIN COMPOSITION, ANTISTATIC COATING AND MOLDED ARTICLE

[75] Inventors: Takeshi Fujii; Manabu Ishikawa, both of Sodegaura, Japan

[73] Assignee: Sumitomo Chemical Company, Limited, Osaka, Japan

[21] Appl. No.: 384,102

[22] Filed: Feb. 6, 1995

[30] Foreign Application Priority Data

Feb. 4, 1994 [JP] Japan ..... 6-012639

[51] Int. Cl.[6] ..... H01B 1/00; H01B 1/18

[52] U.S. Cl. ..... 252/511; 252/502; 524/495; 524/496

[58] Field of Search ..... 252/502, 510, 252/511; 524/495, 496

[56] References Cited

U.S. PATENT DOCUMENTS

| | | | |
|---|---|---|---|
| 5,149,465 | 9/1992 | Ueki et al. | 252/511 |
| 5,171,479 | 12/1992 | Maki et al. | 252/511 |
| 5,322,874 | 6/1994 | Fujii et al. | 524/277 |
| 5,334,636 | 8/1994 | Fujii et al. | 524/449 |
| 5,371,134 | 12/1994 | Inoue | 252/511 |

FOREIGN PATENT DOCUMENTS

| | | |
|---|---|---|
| A20506386 | 9/1982 | European Pat. Off. . |
| A10562179 | 9/1993 | European Pat. Off. . |
| A3-153793 | 7/1991 | Japan . |

OTHER PUBLICATIONS

Derwent WPI, JP 3153793, Jul. 1, 1991, Week 9132 (Abstract).

*Primary Examiner*—Paul Lieberman

*Assistant Examiner*—M. Kopec

*Attorney, Agent, or Firm*—Cushman Darby & Cushman, L.L.P.

[57] ABSTRACT

Provided is an electroconductive resin composition made of:

(a) about 100 parts by weight of a polyphenylene ether or a mixture of a polyphenylene ether and a styrene resin having a weight ratio of polyphenylene ether:styrene resin of less than 100:0 to greater than about 5:95;

(b) about 1 to about 50 parts by weight of a carboxylic acid amide wax having a high softening point;

(c) about 5 to about 35 parts by weight of a carbon black having a dibutylphthalate adsorption of about 70 ml/100 gm or more;

(d) optionally 0 to about 50 parts by weight of a rubber material;

(e) optionally 0 to about 50 parts by weight of an electroconductive inorganic filler;

(f) optionally 0 to about 20 parts by weight of a polyolefin resin; and (g) optionally 0 to about 30 parts by weight of a non-electroconductive inorganic filler. Also provided are an antistatic coating and a molded article made from the resin composition.

19 Claims, No Drawings

ELECTROCONDUCTIVE RESIN COMPOSITION, ANTISTATIC COATING AND MOLDED ARTICLE

BACKGROUND OF THE INVENTION

1. Field of the Invention

The present invention relates to an electroconductive resin composition having excellent antistatic and electroconductive properties, processability, and thermal resistance. Molded articles and coatings manufactured from the electroconductive resin composition exhibit increased resistance to bleeding.

2. Description of Related Art

A polyphenylene ether resin is a thermoplastic resin having excellent mechanical properties, thermal resistance and dimensional stability.

However, use of polyphenylene ether resin alone results in articles having unacceptable impact strength and solvent resistance. Furthermore, polyphenylene ether resin has a high melt viscosity which results in an undesirable processability. Heretofore, the processability has been improved by blending the polyphenylene ether resin with a flowability improving agent or with a polystyrene resin, which is compatible with the polyphenylene ether resin. The processability, however, is still inadequate, even with the use of a flowability improving agent or a polystyrene resin.

The processing temperature of conventional polyphenylene ether resin compositions are generally 240° C. to 350° C. Molded articles made from these compositions exhibit problems with the flowability improving agent causing bleeding on the surface thereof, especially in the case of a processing at a high temperature.

Furthermore, many polyphenylene ether resin compositions are non-electroconductive and therefore cannot be used as an antistatic coating on a molded article unless the article is first undercoated with electroconductive primers, or electroconductive particles, flakes, fibers, such as electroconductive carbon blacks.

Demand for developing materials having resistance to bleeding, excellent heat resistance, dimensional stability, antistatic properties, and electroconductive properties, in electric and electronics fields has increased recently.

SUMMARY OF THE INVENTION

A purpose of the present invention is to provide a resin composition having excellent processability.

Another purpose of the present invention is to obtain a molded article having improved resistance to bleeding.

The present inventors have found a resin composition having excellent electroconductive properties, processability, thermal resistance, and improved resistance to bleeding, by adding a carboxylic acid amide wax having a high softening point to an electroconductive composition. The electroconductive composition comprises a polyphenylene ether resin or a polyphenylene ether resin and a styrene resin, and carbon black.

DETAILED DESCRIPTION OF THE PREFERRED EMBODIMENTS

The present invention relates to an electroconductive resin composition comprising:

(a) about 100 parts by weight of a polyphenylene ether or a mixture of a polyphenylene ether and a styrene resin having a weight ratio of polyphenylene ether:styrene resin of less than 100:0 to greater than about 5:95;

(b) about 1 to about 50 parts by weight of a carboxylic acid amide wax having a high softening point;

(c) about 5 to about 35 parts by weight of a carbon black having a dibutylphthalate adsorption of about 70 ml/100 gm or more;

(d) optionally 0 to about 50 parts by weight of a rubber material;

(e) optionally 0 to about 50 parts by weight of an electroconductive inorganic filler;

(f) optionally 0 to about 20 parts by weight of a polyolefin resin; and (g) optionally 0 to about 30 parts by weight of a non-electroconductive inorganic filler.

COMPONENT (a)

Examples of the polyphenylene ether (a) that can be used in the present invention are polymers obtained by oxidative polymerization of one or more phenol compounds with oxygen or a gas containing oxygen in the presence of an oxidative coupling catalyst, wherein the phenol compounds are represented by the following general formula 1:

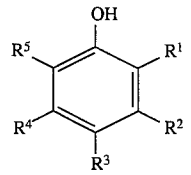

(1)

$R^1$, $R^2$, $R^3$, $R^4$ and $R^5$ each represents a hydrogen, a halogen atom, a hydrocarbon group or a substituted hydrocarbon group and at least one of them is a hydrogen atom. Examples of $R^1$, $R^2$, $R^3$, $R^4$ and $R^5$ include: hydrogen, chlorine, bromine, fluorine, iodine, methyl, ethyl, n-propyl, isopropyl, pri-butyl, sec-butyl, t-butyl, chloroethyl, hydroxyethyl, phenylethyl, benzyl, hydroxymethyl, carboxyethyl, methoxycarbonylethyl, cyanoethyl, phenyl, chlorophenyl, methylphenyl, dimethylphenyl, ethylphenyl and allyl.

Examples of phenol compounds represented by formula (1) include phenol, o-cresol, m-cresol, p-cresol, 2,6-dimethylphenol, 2,5-dimethylphenol, 2,4-dimethylphenol 3,5-dimethylphenol, 2-methyl-6-phenylphenol, 2,6-diphenylphenol, 2,6-diethyl-phenol, 2-methyl-6-ethylphenol, 2,3,5-trimethylphenol,2,3,6- 2,4,6-trimethylphenol 3-methyl-6-t-butylphenol, thymol and 2-methyl-6-allylphenol.

The polyphenylene ether (a) also includes copolymers of any of the phenol compounds of the above general formula with other phenol compounds, for example, polyhydroxy aromatic compounds such as bisphenol-A, tetrabromobisphenol-A, resorcin, hydroquinone and novolack resins.

Preferably, the polyphenylene ether (a) is a homopolymer of 2,6-dimethylphenol or 2,6-diphenylphenol, or a copolymer of a large amount of 2,6-xylenol with a small amount of 3-methyl-6-t-butylphenol or of 2,3,6-trimethylphenol.

Any oxidative coupling catalyst can be used for the oxidative polymerization of the phenol compounds, as long as the catalyst has polymerization ability.

Further examples of the polyphenylene ether (a) include the above-mentioned polyphenylene ethers onto which styrene compounds or other polymers are grafted. Examples of these styrene compounds include styrene, α-methylstyrene, p-methylstyrene, vinyltoluene and chlorostyrene.

Examples of the styrene resin that can be used in the component (a) are those made from one or more polymerization units selected from styrene, α-methylstyrene, and p-methylstyrene, such as polystyrene, rubber-reinforced polystyrene, poly-α-methylstyrene, poly-p-methylstyrene, styrene-acrylonitrile copolymer and styrene-maleic acid copolymer.

Preferably, the molecular weight of the polyphenylene ether (a) is about 0.3 to about 0.75 dl/gm and a more preferably about 0.35 to about 0.5 dl/gm, measured by intrinsic viscosity using chloroform at 25° C. The most preferred range is about 0.35 to about 0.45 dl/gm. If the molecular weight (intrinsic viscosity) is less than about 0.3 dl/gm, the mechanical strength of the composition is unacceptably low and if the molecular weight (intrinsic viscosity) is more than about 0.75 dl/gm, the processability of the composition is undesirable.

The polyphenylene ether and the styrene resin can be mixed in a ratio of less than 100:0 to greater than about 5:95 (weight ratio of polyphenylene ether:styrene resin). The weight ratio is preferably in the range of about 95:5 to about 10:90, and more preferably is about 90:10 to about 20:80. If the proportion of the polyphenylene ether is less than about 5 weight percent, the processability of the composition is further improved but the heat resistance is undesirable and an object of the present invention cannot be attained.

COMPONENT (b)

Component (b) is a carboxylic acid amide wax having a high softening point. An example of such a wax is that obtained by reacting a diamine with a higher aliphatic monocarboxylic acid and a polybasic acid.

Examples of suitable diamines include: ethylenediamine, 1,3-diamino propane, 1,4-diaminopropane, hexamethylenediamine, m-xylylenediamine, tolylenediamine, p-xylylenediamine, phenylenediamine, isophoronediamine, and mixtures thereof.

Examples of higher aliphatic monocarboxylic acids are saturated aliphatic monocarboxylic acids having about 16 to about 32 carbon atoms and/or saturated aliphatic hydroxy carboxylic acids having about 16 to about 32 carbon atoms. Preferably, the higher aliphatic monocarboxylic acids are saturated aliphatic monocarboxylic acids having about 18 to about 28 carbon atoms and/or saturated aliphatic hydroxy carboxylic acids having about 18 to about 28 carbon atoms.

Examples of such higher aliphatic monocarboxylic acids include palmitic acid, stearic acid, behenic acid, montan acid and hydroxy stearic acid, and mixtures thereof.

Examples of polybasic acids that can be used are basic acids having 2 or more carboxylic acid groups, of which, aliphatic dicarboxylic acids such as malonic acid, succinic acid, adipic acid, pimelic acid, azelaic acid and sebacic acid; aromatic dicarboxylic acids such as phthalic acid and terephthalic acid; alicyclic dicarboxylic acids such as cyclohexane dicarboxylic acid and cyclohexyl succinic acid are exemplary. Preferably, polybasic acid has 2 to 4 carboxylic acid groups.

In the preparation of the component (b), the higher aliphatic monocarboxylic acid and the polybasic acid can be reacted with the diamine while heating. The reaction temperature is generally about 180° C. to about 300° C., and more preferably about 200° C. to about 270° C. The reaction time is generally about 3 to about 7 hours, and preferably is 3 to 5 hours. When this amide reaction is performed, phosphorous acid and/or hypophosphorous acid are preferably added as anti-coloring agents. The amine value of reaction product is preferably about 10 or less, and more preferably 5 or less.

The carboxylic acid amide wax of the component (b) can be obtained by a dehydrating reaction, such as by heating of a higher aliphatic monocarboxylic acid and a polybasic acid in the presence of diamine. The softening point of the carboxylic acid amide wax can be adjusted by altering the type of higher aliphatic monocarboxylic acid used. The softening point of the carboxylic acid amide wax can also be adjusted by changing the amount of polybasic acid used in respect to a fixed amount of aliphatic monocarboxylic acid.

The amount of polybasic acid used is preferably is in the range of about 0.18 to about 1.0 moles per 2 moles of the higher aliphatic monocarboxylic acid.

The amount of the diamine used is preferably in the range of about 1.2 to about 2.0 moles per 2 moles of the higher aliphatic monocarboxylic acid. The amount of the diamine used can be varied according to the amount of the polybasic acid used. For example, the amount of diamine can be equal to the stoichiometric amount sufficient to form carboxylic acid amide by reacting with the higher aliphatic monocarboxylic acid and the polybasic acid.

The melting point of the carboxylic acid amide wax of the component (b) can also be adjusted by adding a conventional higher aliphatic carboxylic acid amide.

The carboxylic acid amide wax is mutually compatible with the component (a) at the softening point temperature of the wax. However, the wax phase can separate from the component (a), due to crystallization if the temperature during processing is below the softening point temperature of the wax. Therefore, the softening point of the carboxylic acid amide wax used in the present invention is preferably less than the processing temperature of the composition, and particularly of component (a).

Generally, the processing temperature of the polyphenylene ether composition is about 240° C. to about 350° C., and preferably 260° C. to 330° C. Therefore, the softening point of the carboxylic acid amide wax used in the present invention is preferably in the range of about 105° C. to about 350° C., and more preferably about 150° C. to about 330° C.

However, when the processing temperature falls outside of the above-mentioned range, for example when stabilizers or plasticizers are added, carboxylic acid amide waxes having lower or higher softening points can be used accordingly.

The above-mentioned softening point is a value measured by the softening point test method of petroleum asphalt (a circular ball method) according to JIS-K2531-1960.

Preferably, the carboxylic acid amide waxes comprise a tetramide compound represented by the following general formula (2):

$$R^9—CONH—R^7—HNOC—R^6—CONH—R^8—HNOC—R^{10} \quad (2).$$

More preferably, the carboxylic acid amide wax contains at least 10% by weight of the tetramide compound.

In the above-mentioned general formula (2), $R^6$ is a divalent organic group $R^7$ and $R^8$ are each the same or different divalent organic groups, and $R^9$ and $R^{10}$ are each the same or different monovalent organic groups.

The tetramide compounds represented by the above-mentioned general formula (2) include, for example, ethylenediamine-stearic acid-sebacic acid polycondensation product, ethylenediamine-stearic acid-adipic acid polycondensation product and m-xylylenediamine-stearic acid-sebacic acid polycondensation product.

In addition to the tetramide compound represented by the general formula (2), a diamide compound represented by the following general formula (3):

$$R^{12}—CNOH—R^{11}—HNOC—R^{13} \quad (3)$$

can be included as part of component (b) in the present invention. In the above-mentioned general formula (3), $R^{11}$ is a divalent organic group, and $R^{12}$ and $R^{13}$ are each the same or different monovalent organic groups.

The diamide compounds represented by the above-mentioned general formula (3) include, for example, ethylene-bis-stearic amide, ethylene-bis-palmitic amide and ethylene-bis-oleic amide.

The amount of component (b) is about 1 to about 50 parts by weight, preferably about 2 to about 30 parts by weight, and more preferably about 2 to about 20 parts by weight per 100 parts by weight of the component (a). If the amount of component (b) is less than about 1 part by weight, the processability of the composition is not sufficiently improved. If the amount of component (b) exceeds about 50 parts by weight, the thermal resistance is undesirable, although the processability is improved.

Carboxylic amide waxes can be prepared, for example, according to the methods described in Japanese Patent Publication (Kokai) 153793/1991.

COMPONENT (c)

The carbon black of the component (c) used in the present invention is selected from those which are used for coloration, reinforcement of rubber or impartation of electroconductivity. In order to efficiently impart electroconductivity, it is necessary that the carbon black has a dibutyl phthalate adsorption of about 70 ml/100 g or more. The dibutyl phthalate adsorption is a value determined according to the method specified in ASTM D2414. The dibutyl phthalate adsorption is preferably about 100 ml/100 g to about 600 ml/100 g. More preferably, the dibutyl phthalate adsorption is 150 ml/100 g to 550 ml/100 g.

Preferred carbon blacks include acetylene black obtained by thermal decomposition of acetylene gas and Ketjen Black obtained by furnace type incomplete combustion of fuel oils. These carbon blacks can efficiently improve electroconductivy using smaller amount than other common types of carbon black.

The amount of the carbon black used is about 5 to about 35 parts by weight, preferably about 5 to about 30 parts by weight, and more preferably about 8 to about 30 parts by weight per 100 parts by weight of the component (a). If the amount is less than about 5 parts by weight, antistatic and electroconductivity properties of the composition are insufficient. If the amount of carbon black is more than about 35 parts by weight, the melt viscosity of the composition is increased during molding whereby the processability of the composition is undesirably decreased.

COMPONENT (d)

Optionally a rubber material can be included in order to improve impact strength. As used herein, rubber material means natural and synthetic polymer materials which are elastic at room temperature.

Preferred rubbers include ethylene-propylene copolymer rubber, ethylene-propylene-non-conjugated diene copolymer rubber, ethylene-butene-1 copolymer rubber, polybutadiene, styrene-butadiene block copolymer rubber, styrene-butadiene copolymer rubber, partially hydrogenated styrene-butadiene-styrene block copolymer rubber, styrene-isoprene-block copolymer rubber, partially hydrogenated styrene-isoprene block copolymer rubber, polyurethane rubber, styrene-grafted ethylene-propylene-non-conjugated diene rubber, styrene-grafted ethylene-propylene copolymer rubber, styrene/acrylonitrile-grafted ethylene-propylene-non-conjugated diene copolymer rubber, styrene/acrylonitrile-grafted-ethylene-propylene copolymer rubber, styrene/methyl methacrylate-grafted-ethylene-propylene-non-conjugated diene copolymer rubber, styrene/methylmethacrylate-grafted-ethylene-propylene copolymer rubber and mixtures thereof. Furthermore, the rubber material can be a modified rubber which is modified with other functional monomers, such as acid or epoxy functional monomers.

The amount of the rubber material is 0 to about 50 parts by weight, and if present, is preferably about 2 to about 48 parts by weight per 100 parts by weight of the component (a). If the amount of rubber material exceeds about 50 parts by weight, the thermal resistance and processability of the composition are undesirably deteriorated.

COMPONENT (e)

Optionally, an electroconductive inorganic filler (e) can be included in the resin composition. The electroconductive inorganic filler can be added to improve electroconductivity and rigidity. Suitable electroconductive inorganic fillers include, for example, surface-treated potassium titanate whisker, carbon fiber, stainless steel fiber and aluminum flake.

These electroconductive inorganic fillers can be used alone or in combination with other conventional types of fillers. Addition of these electroconductive inorganic fillers to the composition of the present invention further improves antistatic or electroconductivity properties of the composition, and is therefore preferred.

The amount of the electroconductive inorganic filler is 0 to about 50 parts by weight, and, if present, is preferably about 2 to about 48 parts by weight per 100 parts by weight of the component (a). If the amount of the filler (e) exceeds about 50 parts by weight, the thermal resistance is improved, but the processability is undesirably deteriorated.

COMPONENT (f)

Optionally, a polyolefin resin (f) can be included in the composition to improve processability. Polyolefin resins include, for example, low density polyethylene, high density polyethylene, linear low density polyethylene, polypropylene and poly-4-methylpentene-1. Preferably, the polyolefin resins are low density polyethylene ("LDPE") or linear low density polyethylene ("LLDPE").

The amount of the polyolefin resin is 0 to about 20 parts by weight, and, if present, preferably about 1 to about 15 parts by weight per 100 parts by weight of the component (a). If the amount of the polyolefin resin exceeds about 20 parts by weight, the processability is improved but undesirable delamination can occur in the molded article at the gate of an injection molded article because the polyolefin resin may not be compatible with the polyolefin ether.

COMPONENT (g)

Optionally, a non-electroconductive inorganic filler (g) can be included in the resin composition to improve rigidity, heat resistance or dimensional stability. Non-electroconductive inorganic fillers include, for example, inorganic fillers such as glass fiber, silica, alumina, calcium carbonate, talc, mica, clay, kaolinite, magnesium sulfate, wollastonite, $TiO_2$, ZnO, $Sb_2O_3$, and mixtures of any of these. The amount of the non-electroconductive inorganic filler is 0 to about 30 parts by weight, and, if present, preferably about 1 to about 25 parts by weight. If the amount of the filler (g) exceeds about 30 parts by weight, the thermal resistance is improved but the impact strength is undesirable decreased.

Besides the aforementioned components, customarily used additives, for example, pigments, flame retardants, plasticizers, anti-oxidant agents and weather proof agents can be included in the composition of the present invention.

The electroconductive resin composition of the present invention can be obtained by blending and melt-kneading the above-mentioned components (a) to (c), and, if desired, the optional components (d), (e), (f) or (g). Conventional methods can be used for kneading, such as an extruder, kneader, roll mixer and Banbury mixer.

The complete description of the thermoplastic resin composition in Japanese Application 06-012639 filed Feb. 4, 1994 is incorporated herein by reference.

As mentioned above, the present resin composition exhibits excellent electroconductivity, processability, and thermal resistance. No undesired bleeding is seen for articles molded from the present composition in which the specified carboxylic acid amide wax having a high softening point has been added to the electroconductive composition comprising the polyphenylene ether resin or the polyphenylene ether resin and the styrene resin, to which carbon black has been added.

The present invention will be explained in detail by the following examples, but it should be understood that they are exemplary only, and should not be constructed as limiting the invention in any manner.

EXAMPLES

The following materials were used to obtain the compositions of the Examples and Comparative Examples.

Polyphenylene Ether; PPE

The polyphenylene ethers (manufactured by sumitomo Chemical Company Ltd.) obtained by homopolymerization of 2,6-dimethylphenol and having an intrinsic viscosity measured by using chloroform at 25° C. of 0.2 dl/g (Example 11), 0.4 dl/g (Examples 1 to 10, 18 to 27, Comparative Examples 1 to 11), 0.46 dl/g (Examples 13 to 17) and 0.70 dl/g (Example 12) were used.

Styrene Resin

A rubber-reinforced polystyrene (HI-PS) and a polystyrene (GP-PS) were used as the styrene resins. A rubber-reinforced polystyrene, Esbrite 500HRY3 (manufactured by Japan Polystyrene Company Ltd.) and a polystyrene, Esbrite 2V-62 manufactured by Japan Polystyrene Company Ltd.) were used.

A N,N'-diphenyladipic amide represented by the following general formula was used.

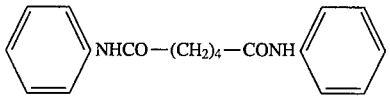

The carbon blacks shown in Table I were used.

TABLE I

| Grade name | Maker | The absorption of DBP (ml/100 g) |
|---|---|---|
| Acetylene black (Denka black) | Denki Chemical Company Ltd. | 212 |
| Ketjen black (600 JD) | Lion Corporation | 495 |
| Furnace black (Vulcan C) | Cabot Carbon Ltd. | 100 |
| Furnace black (Dia black No. 45) | Mitsubishi Chemical Company Ltd. | 55 |

The rubber material used was a styrene-butadiene-styrene block copolymer (SBS) manufactured by Shell Chemical Company Ltd. (Cariflex TR1101)

The electroconductive inorganic fillers used were:

Carbon fibers manufactured by Hercules Inc. (Magnamite 1800 AS);

stainless steel fibers manufactured by Nippon Seisen Company Ltd. (Naslon 12 μm in diameter); and potassium titanate whiskers manufactured by Otsuka Chemical Company Ltd. (Dental WK-200).

The polyolefin resin used was a low density polyethylene manufactured by Sumitomo Chemical Company Ltd. (Sumikathene F210-6)

The non-electroconductive inorganic fillers used were:

Talc manufactured by Hayashi kasei Company Ltd. (5000S); and mica manufactured by Canada Mica Company Ltd. (RepcoMica S-325)

REFERENCE EXAMPLES 1 TO 3

The carboxylic amide waxes used were prepared as follows according to the method described in Japanese Patent Publication (Kokai) 153793/1991, the complete disclosure of which is incorporated herein by reference.

In each Reference Example, carboxylic acids were blended under a nitrogen atmosphere according to the ratios shown in Table II in a 1 liter four-necked flask equipped with a thermometer, a cooler with a condenser, a tube introducing nitrogen and a stirrer and the diamine was gradually added after being dissolved by heating. The dehydration reaction was initiated at a temperature of 160° C. under a nitrogen atmosphere and the reaction continued for 4 to 7 hours at 250° C. until the amine value became less than 5. Each wax was then obtained by first pouring the reaction mixture in a flat basin and (A) collecting the solidified wax.

The thus obtained carboxylic amide waxes were mixtures of ethylenediamine-stearic acid-sebacic acid polycondensation product, e.g., a mixture of [N, N' -bis(2-stearoamide-ethyl) sebacic amide, and N,N-ethylene-bis-stearic amide, respectively represented by formulas (A) and (B):

$C_{17}H_{35}$—CONH—$(CH_2)_2$—HNOC—$(CH_2)_8$—CONH—$(CH_2)_2$—HNOC—$C_{17}H_{35}$ (A)

$C_{17}H_{35}$—CONH—$(CH_2)_8$—CONH—$C_{17}H_{35}$ (B)

REFERENCE EXAMPLE 1

[formula A]/[formula B]=0/100 wt. %

REFERENCE EXAMPLE 2

[formula A]/[formula B]=68/32 wt. %

REFERENCE EXAMPLE 3

[formula A]/[formula B]=100/0 wt. %

TABLE II

| Reference Example | Stearic acid | Sebacic acid | Ethylene -diamine | Softenin g Point |
|---|---|---|---|---|
| 1 | 568 g (2 moles) | — | 60 g (1 mole) | 142° C. |
| 2 | 568 g (2 moles) | 66.8 g (0.33 moles) | 83.5 g (1.30 moles) | 215° C. |
| 3 | 568 g (2 moles) | 20.2 g (1.0 mole) | 120 g (2 moles) | 250° C. |

REFERENCE EXAMPLE 4

The rubber material used was a styrene/methylmethacrylate-grafted-ethylene-propylene-non-conjugated diene copolymer rubber. This rubber material was prepared by the following method.

2200 ml of pure water dissolving 6 g of PLURONIC F68 manufactured by ASAHI DENKA KOUGYO K. K. as a dispersing agent and 300 g of Esprene E502 (44% by weight of propylene content, an iodine value of 8.5 and Moony viscosity of 63 at 120° C.) cut in 3 to 6 mm cubes were provided, stirred and dispersed in suspension in a 5 liters autoclave equipped with a stirrer. Then, t-butylperoxy pivalate (9 grams) and p-benzoquinone (0.18 grams), as radical initiators, and styrene (101 grams) and methylmethacrylate (19 grams), as monomers, were added. The autoclave was immediately placed in an oil bath which had been pre-heated to 30° C. It was heated until 110° C. at a rate of about 1° C./min. and the polymerization reaction was carried out while maintaining the autoclave at 110° C. for 30 minutes. The granular grafted rubber material obtained was dried under vacuum at 95° C. after washing by water and the styrene/methylmethacrylate-grafted-ethylene-propyl ene-non-conjugated diene copolymer rubber (MSEPDM) was obtained.

EXAMPLES 1 TO 27 AND COMPARATIVE EXAMPLES 1 TO 11

The compositions of each of Examples 1 to 27 and Comparative Examples 1 to 11 were blended as shown in Tables 3 to 14 (the blending ratio was parts by weight), extruded by a twin-screw extruder TEM 50 manufactured by Toshiba Machine Company Ltd. at a cylinder temperature of 300° C. and pelletized by a strand cutter after being cooled in a water tank.

After the thus-obtained pellets were dried for 4 hours at 100° C. by hot-air, each test piece was molded by an injection molding machine IS220EN manufactured by Toshiba Machine Company Ltd. at a cylinder temperature of 330° C., an injection pressure of 1270 kg/cm2 and a mold temperature of 80° C.

The thus obtained test pieces were tested by the following methods (1) to (6) to obtain data. Measured results were shown in Tables 3 to 14. Test pieces could not be molded in the case of Comparative Examples 4, 5 and 9.

In the present invention it is important that the compositions are balanced in the following properties and preferably have a surface specific resistivity ("S.S.R.") of $10^{13}$ Ω or less, a melt flow rate ("MFR") of 0.5 g/10 min. or more, a HDT of 85° C. or more, an Izod impact strength of 2 kg·cm/cm or more, and show no delamination and no bleeding.

(1) S.S.R. (Surface specific resistivity; Ω);

A plate of 54 mm×75 mm obtained by the injection molding was subjected to measurement of surface specific resistivity by the high resistivity-meter HIRESTA IP (MCP-HT 260) manufactured by YUKA DENNSHI Company Ltd.

(2) MFR (Melt flow rate; g/10 min.);

MFR was measured by according to ASTM D-1238 with a load of 10 kg and by setting the temperature at 280° C. unless otherwise indicated.

(3) Izod impact strength (kg·cm/cm);

Izod impact strength was measured in accordance with ASTM D-256 by using a notched test piece of 3.2 mm thick.

(4) HDT (° C.);

HDT was measured in accordance with ASTM D-648 under application of a fiber stress of 18.6 kg/cm$^2$.

(5) Delamination;

When no delamination occurred in the test piece obtained by the above-mentioned injection molding, this is shown by "O", and when delamination occurred, this is shown by "x".

(6) Bleeding;

When no bleeding occurred in the test piece obtained by the above-mentioned injection molding, this is shown by "O" and when bleeding occurred, this is shown by "x".

TABLE III

| | Comparative Example 1 | Example 1 | Example 2 | Comparative Example 2 |
|---|---|---|---|---|
| PPE | 61 | 61 | 61 | 61 |
| GP-PS | 24 | 24 | 24 | 24 |
| Amide compound | Reference Example 1 5 | Reference Example 2 5 | Reference Example 3 5 | N,N'-diphenyl-adipic amide 5 |
| Acetylene black | 20 | 20 | 20 | 20 |
| MSEPDM | 10 | 10 | 10 | 10 |
| S.S.R. | $2 \times 10^5$ | $1 \times 10^5$ | $1 \times 10^5$ | $2 \times 10^5$ |
| MFR | 15 | 14 | 12 | 8.6 |
| HDT | 127 | 133 | 135 | 133 |
| Izod impact strength | 9 | 11 | 10 | 9 |
| Delamination | ○ | ○ | ○ | ○ |
| Bleeding | x | ○ | ○ | x |

TABLE IV

| | Example 3 | Example 4 |
|---|---|---|
| PPE | 61 | 61 |
| GP-PS | 14 | 14 |
| Reference Example 2 | 5 | 5 |
| Acetylene black | 20 | 20 |
| MSEPDM | 10 | 10 |
| Non-electroconductive filler | Talc 10 | Mica 10 |
| S.S.R. | $1 \times 10^4$ | $2 \times 10^4$ |
| MFR | 11 | 11 |
| HDT | 135 | 136 |
| izod impact strength | 4 | 3 |
| Delamination | ○ | ○ |
| Bleeding | ○ | ○ |

TABLE V

| | Example 5 | Example 6 | Comparative Example 3 | Example 7 |
|---|---|---|---|---|
| PPE | 60 | 70 | 95 | 80 |
| HI-PS | 35 | 15 | — | 15 |
| GP-PS | — | 10 | — | — |
| Reference Example 2 | 5 | 5 | 5 | 5 |
| Acetylene black | 20 | 20 | 3 | 18 |
| S.S.R. | $3 \times 10^5$ | $3 \times 10^5$ | $>10^{13}$ | $9 \times 10^{12}$ |
| MFR | 18 | 15 | 25 | 10 |
| HDT | 130 | 140 | 170 | 160 |
| Izod impact strength | 3 | 2 | 4 | 3 |
| Delamination | ○ | ○ | ○ | ○ |
| Bleeding | ○ | ○ | ○ | ○ |

TABLE VI

| | Example 8 | Comparative Example 4 | Comparative Example 5 | Comparative Example 6 |
|---|---|---|---|---|
| PPE | 95 | 95 | 95 | 100 |
| Reference Example 2 | 5 | 5 | 5 | — |
| Acetylene black | 20 | 40 | 120 | 22 |
| S.S.R. | $1 \times 10^5$ | $<10^4$ | $<10^4$ | $3 \times 10^5$ |
| MFR | 5 | <0.1 | <0.1 | 0.1 |
| HDT | 172 | — | — | 175 |
| Izod impact strength | 2 | — | — | 2 |
| Delamination | ○ | — | — | ○ |
| Bleeding | ○ | — | — | ○ |

TABLE VII

| | Example 10 | Comparative Example 7 | Example 11 | Example 12 | Example 11 |
|---|---|---|---|---|---|
| PPE | 85 | 59 | 95 | 95 | 95 |
| Reference Example 2 | 15 | 41 | 5 | 5 | 5 |
| Acetylene black | 20 | 20 | 20 | 20 | 20 |
| S.S.R. | $1 \times 10^5$ | $1 \times 10^5$ | $1 \times 10^5$ | $1 \times 10^5$ | $3 \times 10^5$ |
| MFR | 20 | >250 | 79 | 0.3 | 2 |
| HDT | 145 | 80 | 160 | 175 | 173 |

TABLE VII-continued

| | Example 10 | Comparative Example 7 | Example 11 | Example 12 | Example 11 |
|---|---|---|---|---|---|
| Izod impact strength | 2 | <1 | <2 | 3 | 2 |
| bleeding | ○ | ○ | ○ | ○ | ○ |

TABLE VIII

| | Example 14 | Example 15 | Example 16 | Example 17 |
|---|---|---|---|---|
| PPE | 90 | 60 | 40 | 20 |
| HI-PS | 5 | 35 | 55 | 75 |
| Reference Example 2 | 5 | 5 | 5 | 5 |
| Acetylene black | 20 | 20 | 20 | 20 |
| S.S.R. | $2 \times 10^5$ | $2 \times 10^5$ | $2 \times 10^5$ | $1 \times 10^5$ |
| MFR | 3 | 11 | 28 | 63 |
| HDT | 157 | 132 | 107 | 87 |
| Izod impact strength | 2 | 3 | 3 | 2 |
| Bleeding | ○ | ○ | ○ | ○ |

TABLE IX

| | Example 18 | Example 19 | Comparative Example 8 |
|---|---|---|---|
| PPE | 95 | 95 | 95 |
| Reference Example 2 | 5 | 5 | 5 |
| Ketjen black | 8 | — | — |
| Vulcan C | — | 33 | — |
| Dia black | — | — | 40 |
| S.S.R. | $2 \times 10^5$ | $4 \times 10^7$ | $>10^{13}$ |
| MFR | 2 | 8 | 10 |
| HDT | 176 | 170 | 168 |
| Izod impact strength | 3 | 2 | <2 |
| Bleeding | ○ | ○ | ○ |

TABLE X

| | Example 20 | Comparative Example 9 |
|---|---|---|
| PPE | 80 | 60 |
| Reference Example 2 | 5 | 5 |
| Acetylene black | 20 | 20 |
| SBS | 15 | 35 |
| S.S.R. | $8 \times 10^8$ | — |
| MFR | 0.5 | <0.01 |
| HDT | 150 | — |
| Izod impact strength | 3 | — |
| Bleeding | ○ | ○ |

TABLE XI

| | Example 21 | Example 22 | Example 23 |
|---|---|---|---|
| PPE | 95 | 95 | 95 |
| Reference Example 2 | 5 | 5 | 5 |
| Acetylene black | 20 | 20 | 20 |
| Electroconductive inorganic filler | 5 (Carbon | 5 (Stainless | 5 (Potassium |

TABLE XI-continued

| | Example 21 | Example 22 | Example 23 |
|---|---|---|---|
| (kinds) | fiber) | fiber) | titanic whisker) |
| S.S.R. | $<10^4$ | $<10^4$ | $5 \times 10^5$ |
| MFR | 4 | 4 | 4 |
| HDT | 176 | 173 | 174 |
| Izod impact strength | 3 | 3 | 2 |
| Bleeding | o | o | o |

TABLE XII

| | Example 24 | Comparative Example 10 |
|---|---|---|
| PPE | 93 | 70 |
| Reference Example 2 | 5 | 5 |
| Acetylene black | 20 | 20 |
| Low-density polyetheylene | 2 | 25 |
| S.S.R. | 1 × 10 | 2 × 10 |
| MFR | 6 | 16 |
| HDT | 170 | 162 |
| Izod impact strength | 3 | 5 |
| Delamination | o | o |
| Bleeding | o | o |

TABLE XIII

| | Comparative Example 11 |
|---|---|
| PPE | 61 |
| GP-PS | 24 |
| Reference Example 2 | 5 |
| MSEPDM | 10 |
| S.S.R. | $>10^{13}$ |
| MFR | 40 |
| HDT | 130 |
| Izod impact strength | 30 |
| Delamination | o |
| Bleeding | o |

TABLE XIV

| | Example 25 | Example 26 | Example 27 |
|---|---|---|---|
| PPE | 61 | 61 | 61 |
| GP-PS | 24 | 24 | 24 |
| Reference Example 1 | 1 | 2.5 | 4 |
| Reference Example 3 | 4 | 2.5 | 1 |
| Acetylene black | 20 | 20 | 20 |
| MSEPDM | 10 | 10 | 10 |
| S.S.R. | $1 \times 10^5$ | $1 \times 10^5$ | $1 \times 10^5$ |
| MFR | 12 | 13 | 14 |
| HDT | 134 | 133 | 130 |
| Izod impact strength | 9 | 10 | 10 |
| Delamination | o | o | o |
| Bleeding | o | o | o |

We claim:

1. An electroconductive resin composition comprising:

(a) about 100 parts by weight of a polyphenylene ether or a mixture of a polyphenylene ether and a styrene resin having a weight ratio of polyphenylene ether:styrene resin of less than 100:0 to greater than about 5:95;

(b) about 1 to about 50 parts by weight of a carboxylic acid amide wax having a high softening point which comprises a tetramide compound represented by formula (2):

$$R^9—CONH—R^7—HNOC\ R^6—CONH—R^8—HNOC—R^{10},$$

wherein $R^6$ is a divalent organic group, $R^7$ and $R^8$ are each the same or different divalent organic groups, and $R^9$ and $R^{10}$ are each the same or different monovalent organic groups;

(c) about 5 to about 35 parts by weight of a carbon black having a dibutylphthalate adsorption of about 70 ml/100 gm or more;

(d) optionally 0 to about 50 parts by weight of a rubber material;

(e) optionally 0 to about 50 parts by weight of an electroconductive inorganic filler;

(f) optionally 0 to about 20 parts by weight of a polyolefin resin; and (g) optionally 0 to about 30 parts by weight of a non-electroconductive inorganic filler.

2. The resin composition according to claim 1, wherein the carboxylic acid amid wax is obtained by reacting a diamine with a higher aliphatic monocarboxylic acid and a polybasic acid.

3. The resin composition according to claim 2, wherein the higher aliphatic monocarboxylic acid is selected from the group consisting of saturated aliphatic monocarboxylic acids having about 16 to about 32 carbon atoms, saturated aliphatic hydroxy carboxylic acids having about 16 to about 32 carbon atoms, and mixtures thereof.

4. The resin composition according to claim 2, wherein the higher aliphatic monocarboxylic acid is selected from the group consisting of saturated aliphatic monocarboxylic acids having about 18 to about 28 carbon atoms, saturated aliphatic hydroxy carboxylic acids having about 18 to about 28 carbon atoms, and mixtures thereof.

5. The resin composition according to claim 1, wherein the tetramide compound represented by the above-mentioned general formula (2) is selected from the group consisting of ethylenediamine-stearic acid-sebacic acid polycondensation product, ethylenediamine-stearic acid-adipic acid polycondensation product, m-xylylenediamine-stearic acid-sebacic acid polycondensation product, and mixtures thereof.

6. The resin composition according to claim 1, wherein the tetramide compound represented by the above-mentioned general formula (2) is selected from the group consisting of ethylenediamine-stearic acid-sebacic acid polycondensation product, ethylenediamine-stearic acid-adipic acid polycondensation product, m-xylylenediamine-stearic acid-sebacic acid polycondensation product, and mixtures thereof; and the diamide compound represented by the above-mentioned general formula (3) is selected from the group consisting of ethylene-bis-stearic amide, ethylene-bis-palmitic amide, ethylene-bis-oleic amide, and mixture thereof.

7. The resin composition according to claim 1, wherein the electroconductive inorganic filler is a stainless steel fiber.

8. The resin composition according to claim 1, wherein the electroconductive inorganic filler is a whisker of potassium titanate.

9. The resin composition according to claim 1, wherein the polyolefin resin (f) is a low density polyethylene or a linear low density polyethylene.

10. The resin composition according to claim 1, wherein component (g) is present and selected from the group consisting of talc, mica, and mixtures thereof.

11. The resin composition according to claim 1, wherein the polyphenylene ether has an intrinsic viscosity of about 0.3 to about 0.75 dl/g.

12. The resin composition according to claim 1, wherein styrene resin is present and is a styrene homopolymer, a rubber-reinforced polystyrene, or a mixture thereof.

13. The resin composition according to claim 1, wherein the softening point temperature of the wax (b) is less than a processing temperature of the resin composition.

14. The resin composition according to claim 1, wherein the softening point temperature of the wax (b) is less than a processing temperature of the component (a).

15. The resin composition according to claim 1, wherein the softening point temperature of wax (b) is about 105° C. to about 350° C.

16. The resin composition according to claim 1, wherein the softening point temperature of wax (b) is about 150° C. to about 330° C.

17. An antistatic coating comprising the resin composition of claim 1.

18. A molded article made from the composition of claim 1.

19. An electroconductive resin composition comprising:

(a) about 100 parts by weight of a polyphenylene ether or a mixture of a polyphenylene ether and a styrene resin having a weight ratio of polyphenylene ether:styrene resin of less than 100:0 to greater than about 5:95;

(b) about 1 to about 50 parts by weight of a carboxylic acid amide wax having a high softening point which comprises a mixture of a compound represented by the formula:

$$R^9—CONH—R^7—HNOC—R^6—CONH—R^8—HNOC—R^{10},$$

wherein $R^6$ is a divalent organic group, $R^7$ and $R^8$ are each the same or different divalent organic groups, and $R^9$ and $R^{10}$ are each the same or different monovalent organic groups; and a compound represented by the formula (3):

$$R^{12}—CNOH—R^{11}—HNOC—R^{13},$$

wherein, $R^{11}$ is divalent organic group, and $R^{12}$ and $R^{13}$ are each the same or different monovalent organic groups;

(c) about 5 to about 35 parts by weight of a carbon black having a dibutylphthalate adsorption of about 70 ml/100 gm or more;

(d) optionally 0 to about 50 parts by weight of a rubber material;

(e) optionally 0 to about 50 parts by weight of an electroconductive inorganic filler;

(f) optionally 0 to about 20 parts by weight of a polyolefin resin; and (g) optionally 0 to about 30 parts by weight of a non-electroconductive inorganic filler.

* * * * *